US007060973B2

(12) United States Patent
Gonin

(10) Patent No.: US 7,060,973 B2
(45) Date of Patent: Jun. 13, 2006

(54) MULTI-ANODE DETECTOR WITH INCREASED DYNAMIC RANGE FOR TIME-OF-FLIGHT MASS SPECTROMETERS WITH COUNTING DATA ACQUISITION

(75) Inventor: Marc Gonin, Bern (CH)

(73) Assignee: Ionwerks, Inc., Houston, TX (US)

( * ) Notice: Subject to any disclaimer, the term of this patent is extended or adjusted under 35 U.S.C. 154(b) by 0 days.

(21) Appl. No.: 10/957,897

(22) Filed: Oct. 4, 2004

(65) Prior Publication Data

US 2005/0040325 A1 Feb. 24, 2005

Related U.S. Application Data

(63) Continuation of application No. 10/628,145, filed on Jul. 28, 2003, now Pat. No. 6,812,454, which is a continuation of application No. 09/720,182, filed as application No. PCT/US99/13965 on Jun. 21, 1999, now Pat. No. 6,646,252.

(51) Int. Cl.
*H01J 49/00* (2006.01)

(52) U.S. Cl. ..... 250/287; 250/288

(58) Field of Classification Search ..... 250/287, 250/288

See application file for complete search history.

(56) References Cited

U.S. PATENT DOCUMENTS

| | | | | |
|---|---|---|---|---|
| 5,073,713 | A | 12/1991 | Smith et al. | |
| 5,367,162 | A | 11/1994 | Holland et al. | |
| 5,644,128 | A | 7/1997 | Wollnik et al. | |
| 5,777,325 | A | 7/1998 | Weinberger et al. | |
| 5,777,326 | A | 7/1998 | Rockwood | |
| 5,973,322 | A | 10/1999 | Rockwood | |
| 6,747,271 | B1 * | 6/2004 | Gonin et al. | 250/281 |
| 6,812,454 | B1 * | 11/2004 | Gonin | 250/287 |
| 2003/0111597 | A1 * | 6/2003 | Gonin et al. | 250/287 |
| 2004/0217275 | A1 * | 11/2004 | Gonin et al. | 250/287 |
| 2005/0127289 | A1 * | 6/2005 | Fuhrer et al. | 250/288 |

FOREIGN PATENT DOCUMENTS

| | | |
|---|---|---|
| GB | 9801565.4 | 1/1998 |
| GB | 9804286.4 | 2/1998 |
| GB | 9810867.3 | 5/1998 |
| GB | 9813224.4 | 6/1998 |
| WO | WO-99/38191 A2 | 7/1999 |

OTHER PUBLICATIONS

D.C. Barbacci; D.H. Russell; J.A. Schultz; J. Holocek; S. Ulrich; W. Burton; and M. Van Stipdonk; Multi-anode Detection in Electrospray Ionization Time-of-Flight Mass Spectrometry; J Am Soc Mass Spectrom 1998, 9, 1328-1333.

Michael J. Kristo and Christie G. Enke; System for simultaneous count/current measurement with a dual-mode photo/particle detector; Rev. Sci. Instrum. 59 (3), Mar. 1988 pp. 438-442.

* cited by examiner

*Primary Examiner*—Nikita Wells
*Assistant Examiner*—David A. Vanore
(74) *Attorney, Agent, or Firm*—Fulbright & Jaworski L.L.P.

(57) ABSTRACT

A new detection scheme for time-of-flight mass spectrometers is disclosed. This detection scheme allows extending the dynamic range of spectrometers operating with a counting technique (TDC). The extended dynamic range is achieved by constructing a multiple anode detector wherein the individual anodes detect different fractions of the incoming particles. Different anode fractions are achieved by varying the size, physical location, and electrical/magnetic fields of the various anodes. An anode with a small anode fraction avoids saturation and allows an ion detector to render an accurate count of ions even for abundant species.

6 Claims, 6 Drawing Sheets

A MULTI-ANODE DETECTOR WITH INCREASED DYNAMIC RANGE FOR TIME-OF-FLIGHT MASS SPECTROMETERS WITH COUNTING DATA ACQUISITION

Scheme of spectra treatment for a 2 anode detector with unequal anode fractions

MULTI-ANODE DETECTOR WITH INCREASED DYNAMIC RANGE FOR TIME-OF-FLIGHT MASS SPECTROMETERS WITH COUNTING DATA ACQUISITION

BACKGROUND OF THE INVENTION

1. Field of the Invention

The present invention is useful in time-of-flight mass spectrometry (TOFMS), a method for qualitative and quantitative chemical analysis. Many TOFMS work with counting techniques, in which case the dynamic range of the analysis is strongly limited by the measuring time and the cycle repetition rate. This invention describes a detection method to increase the dynamic range of elemental-, isotopic-, or molecular analysis with counting techniques.

2. Description of the Prior Art

Definition of Terms

Anode: The part of a particle detector, which receives the electrons from the electron multiplier.

Anode Fraction: The fraction of the total amount of particles, which is detected by a specific anode.

Single Signal: The signal pulse produced by a detector when a single particle hits the detector. A counting electronics counts the single signals and their arrival.

Signal: A superposition of single signals, caused by particles of one specie hitting the detector within a very short time.

Description

Time-of-flight mass spectrometers (TOFMS, see FIG. 1) allow the acquisition of wide-range mass spectra at high speeds because all masses are recorded simultaneously. Most TOFMS work in a cyclic mode. In each cycle, a certain number of particles (up to several thousand) are extracted and traverse a flight section towards a detector. Each particle's time-of-flight is recorded to deliver information about its mass. Thus, in each cycle, a complete time spectrum is recorded and added to a histogram. The repetition rate of this cycle is commonly in the range of 1 to 50 kHz.

If several particles of one specie are extracted in one cycle, these particles will arrive at the detector within a very short time period (as short as 1 nanosecond). When using an analog detection scheme (transient recorder, oscilloscope) this does not cause a problem because these detection schemes deliver a signal which is proportional to the number of particles arriving within a certain sampling time. However, when a counting detection scheme is used (time-to-digital converter, TDC), the electronics cannot distinguish two or more particles of the same specie arriving simultaneously at the detector. Additionally, most TDCs have dead times (typically 20 nanoseconds), which prevent the detection of more than one particle or each mass in one extraction cycle.

For example, when analyzing an air sample with 12 particles per cycle, there will be approximately ten nitrogen molecules (80% $N_2$ in air, mass=28 amu) per extraction cycle. These ten $N_2$ particles will hit the detector within 2 nanoseconds (in a TOFMS of good resolving power). Even a fast TDC with only 0.5 nanoseconds timing resolution and no deadtime will not be able to detect all these particles because only one signal can be recorded each 0.5 nanoseconds. The detection system gets saturated at this intense peak. FIG. 2 shows these ten particles 5 of mass 28 amu impinging a detector of prior art. The TDC will register only the first of all these ten particles. Therefore peaks for abundant specie ($N_2$ and $O_2$) are artificially small and are recorded too early because only the first particle is registered. This effect is termed "saturation." FIG. 9 shows the effects of saturation on the spectrum peaks for $N_2$ and $O_2$. To give a better overview, three different scalings of the same spectrum are shown. The abundance should be 78% $N_2$, 21% $O_2$ and 1% Ar. As shown in FIG. 9, the $N_2$ peak and the $O_2$ peak are much too small compared to the Ar peak which is not saturated (top and bottom panel). Saturation is so strong that there are virtually no counts during the dead time of approximately 20 nanoseconds registered (middle panel).

In an attempt to prevent saturation, some prior art detectors use multiple anodes. An individual TDC channel records each anode. FIG. 3 shows a prior art detector with four anodes of equal size. This allows the identification of four times larger intensities compared with a single anode detector. However, even with four anodes, the detection of the ten $N_2$ particles leads to saturation because there are more than two particles per anode on average 6 and 7.

With more anodes, saturation could in principle be avoided, but as each anode requires its own TDC channel, this solution becomes complex and expensive.

SUMMARY OF THE INVENTION

Instead of using multiple equal sized anodes, the present invention uses multiple anodes wherein each anode has a different anode fraction. By reducing anode fraction, saturation can be eliminated. One method for achieving a different anode fraction is through use of anodes of different sizes as shown in FIG. 4 at 46 and 47. The example in FIG. 4 uses two unequal size anodes with a size ratio of approximately 1:9. As a result, the small anode only detects one particle 8 per cycle, just on the edge of saturation for $N_2$. Less abundant particles like Ar (1% abundance in air=0.12 particles per cycle) are primarily detected and evaluated from the big anode which gives low statistical errors. Thus, with 2 anodes of unequal size it is possible to increase the dynamic range by a factor often or more. A prior art detector with equal sized anodes would require ten anodes to obtain the same improvement. It should be apparent that the dynamic range can be increased either by decreasing the anode fraction of the small anode or by adding additional anodes with even lower anode fractions. It is also possible to achieve differing fractions and to make such fractions adjustable by applying electric fields to influence the paths of incoming ions as shown in FIGS. 6 and 7.

BRIEF DESCRIPTION OF THE DRAWINGS

A better understanding of the present invention can be obtained when the following detailed description of the preferred embodiment is considered in conjunction with the following drawings in which.

DETAILED DESCRIPTION OF THE PREFERRED EMBODIMENT

Figure 1:
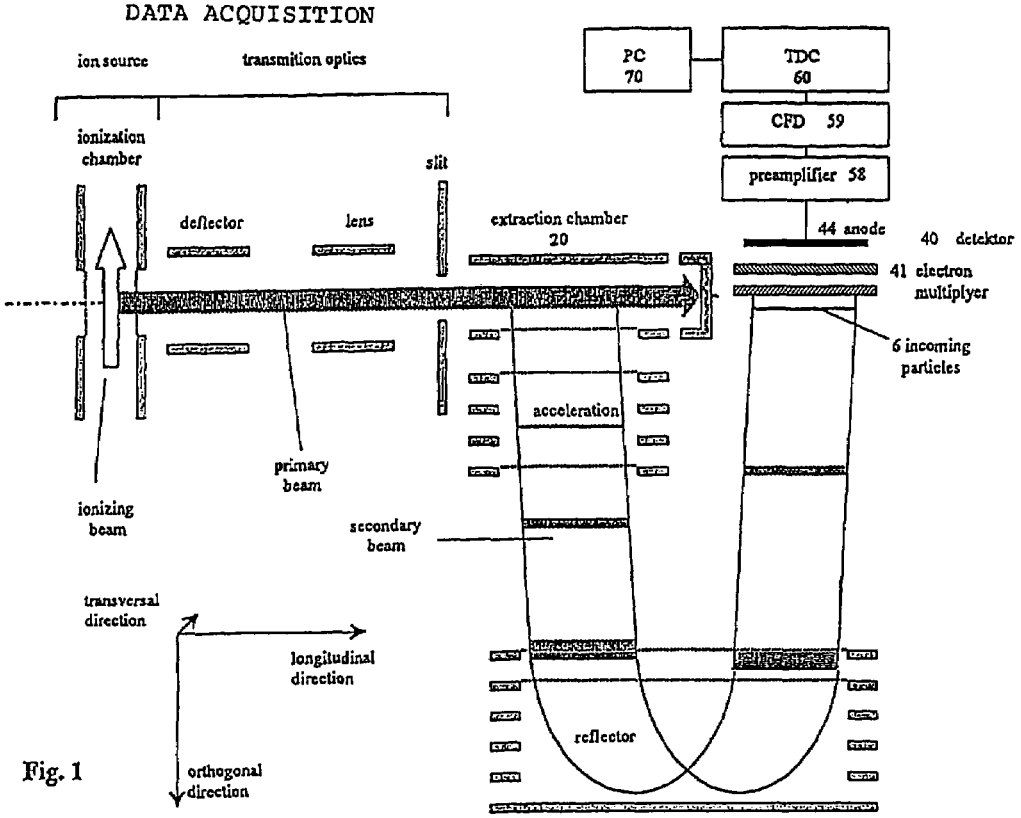
FIG. 1 is a schematic diagram showing a time-of-flight mass spectrometer to which the invention can be advantageously applied.
Figure 2:
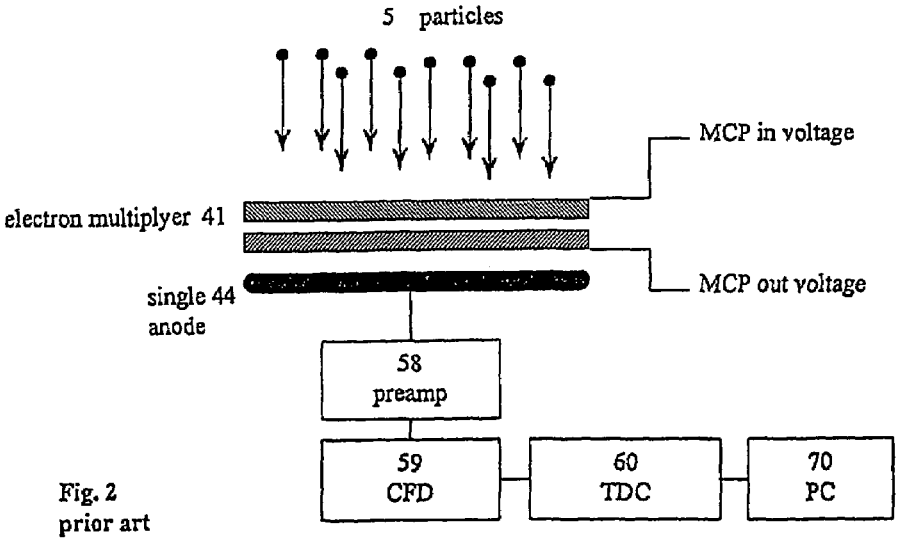
Fig. 2 prior art
FIG. 2 is a schematic diagram showing a single anode detector of the prior art.
Figure 3:
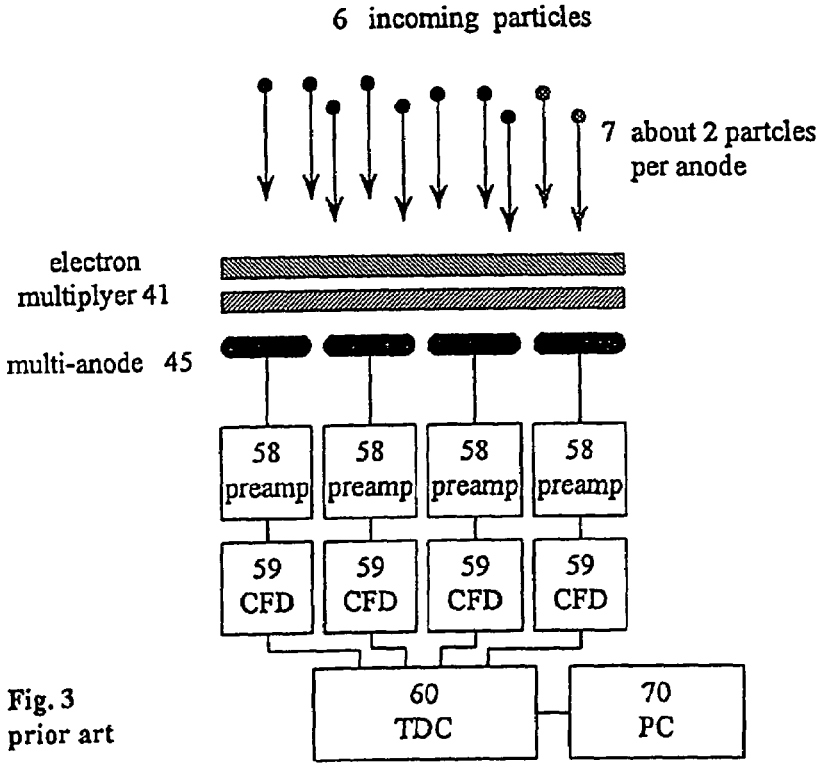
Fig. 3 prior art
FIG. 3 is a schematic diagram showing a multiple anode detector of the prior art.

Referring now to FIG. 1, a typical TOFMS is shown. In the depicted TOFMS, gaseous particles are ionized and accelerated into a flight tube from an extraction chamber 20. Some TOFMS, such as the one illustrated, use reflectors to increase the apparent length of the flight tube and, hence, the resolution of the TOFMS. At the detector of the TOFMS 40, ions 6 impinge an electron multiplier 41 causing an emission of electrons. Anodes 44 detect the electrons from the electron multiplier 41 and the signal is then processed through a preamplifier 58, a CFD (constant fraction discriminator) 59, and a TDC 60. A histogram that reflects the composition of the sample is generated either in the TDC 60 or in a digital computer (PC) 70 connected to the TDC 60.

Figure 4:
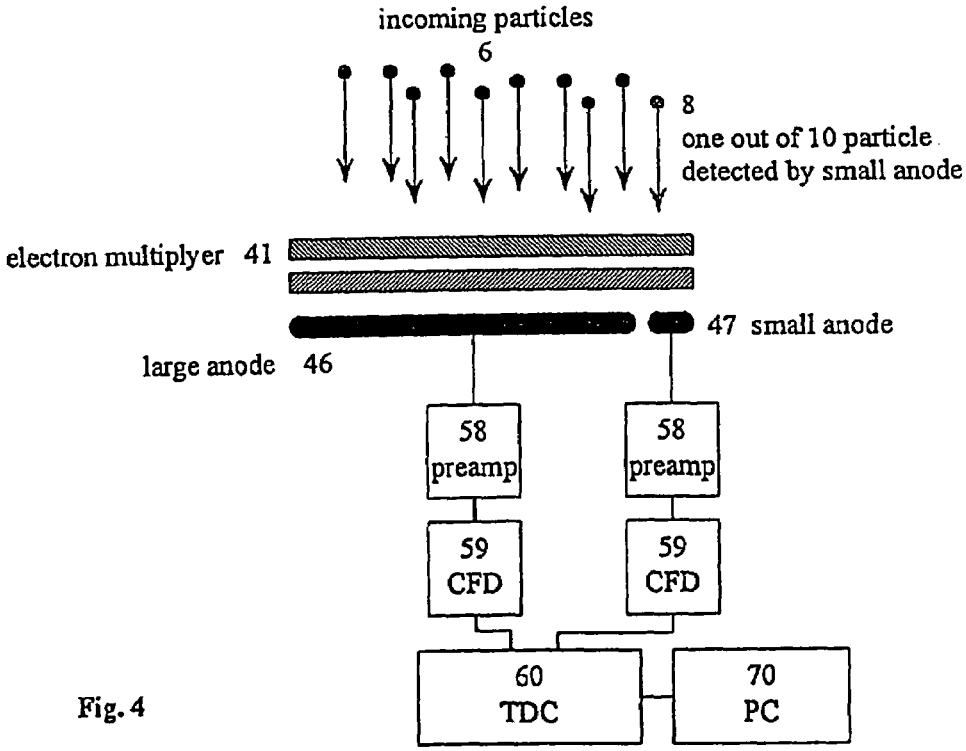
FIG. 4 is a schematic diagram showing a detector with multiple, unequal-sized anodes in accordance with the present invention.

One preferred embodiment of the present invention is shown in FIG. 4. In this embodiment, unequal-sized anodes 46 and 47 are used in the detector. The detection fraction of the small anode is small enough so that on average it detects only one particle 8 out of the ten incoming particles 6 of the specie. The embodiment shown in FIG. 4 uses two unequal size anodes with a size ratio of approximately 1:9. As a result, the small anode only detects one particle 8 per cycle, just on the edge of saturation for $N_2$. Less abundant particles like Ar (1% abundance in air=0.12 particles per cycle) are primarily detected and evaluated from the big anode which gives low statistical errors. Thus, with 2 anodes of unequal size it is possible to increase the dynamic range by a factor of ten or more.

Figure 5:
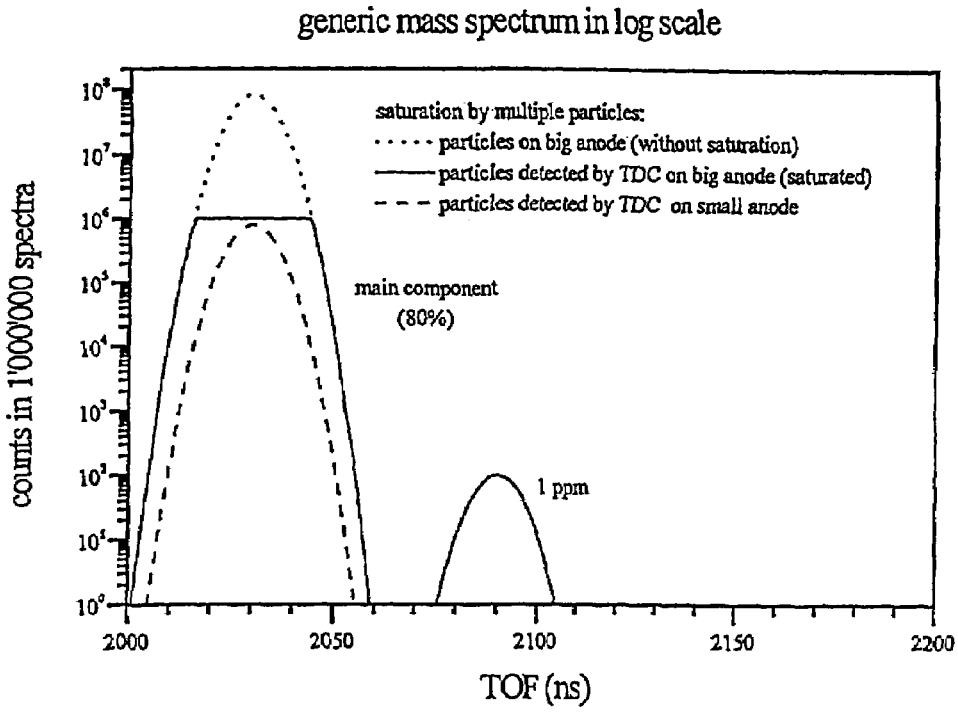
FIG. 5 is a graph showing a generic spectrum including an 80% component and a 1 ppm component to depict the saturation effects suffered by prior art detectors and the spectrums generated by a detector of the present invention.
Figure 5:
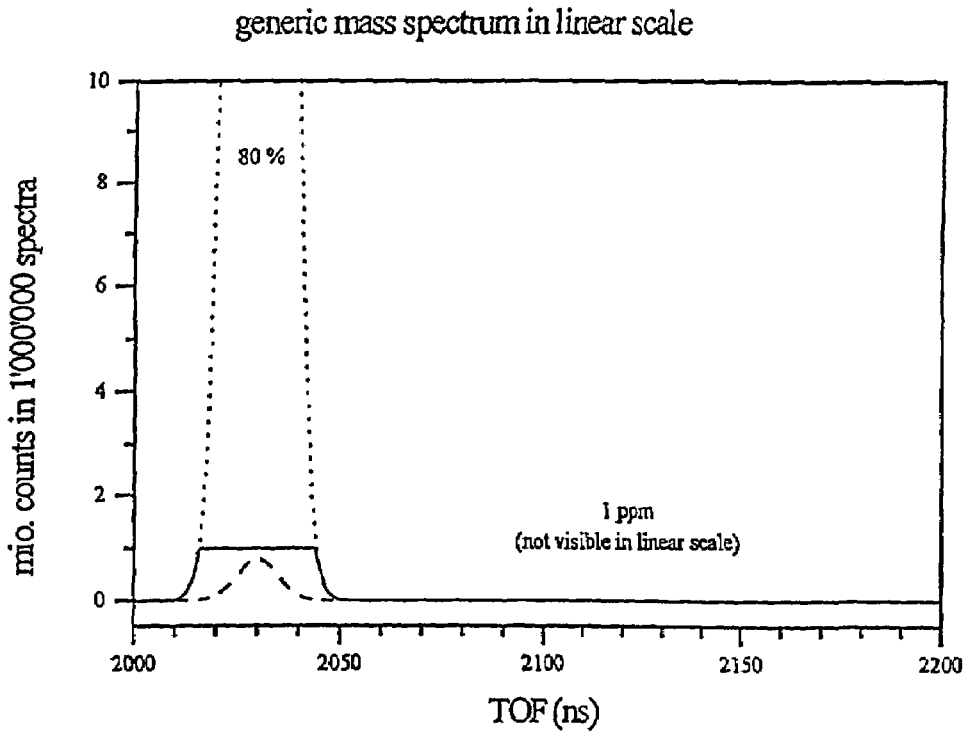

FIG. 5 shows the results achieved by using the detector of FIG. 4. The top graph of FIG. 5 is in logarithmic scale, while the bottom graph is linear. The spectrum recorded by the large anode is shown as a solid line, while the smaller anode's spectrum is shown as a dashed line. As shown in FIG. 5, the large anode becomes saturated in the area of an abundant specie (shown between 2000 and 2060 nanoseconds TOF). However, less abundant specie are recorded accurately by the large anode. Also shown in FIG. 5, the anode with the smaller anode fraction records the abundant specie without becoming saturated. Thus, by using anodes with different anode fractions, it becomes possible to create an entire spectrum without saturation effects by evaluating minor species (e.g., 1 ppm) on the large anode and major species on the small anode.

Figure 6:
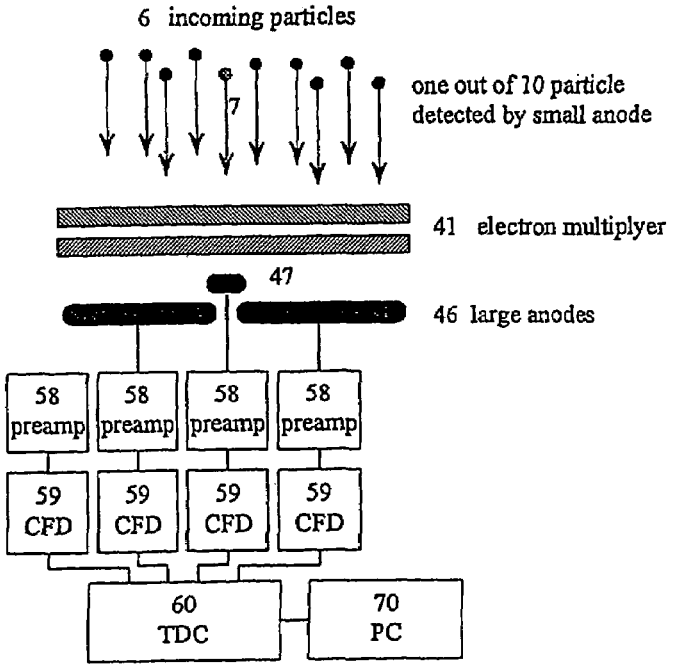
FIG. 6 is a schematic diagram showing an alternate embodiment of the detector of the present invention with two large anodes and one small anode.
Figure 7:
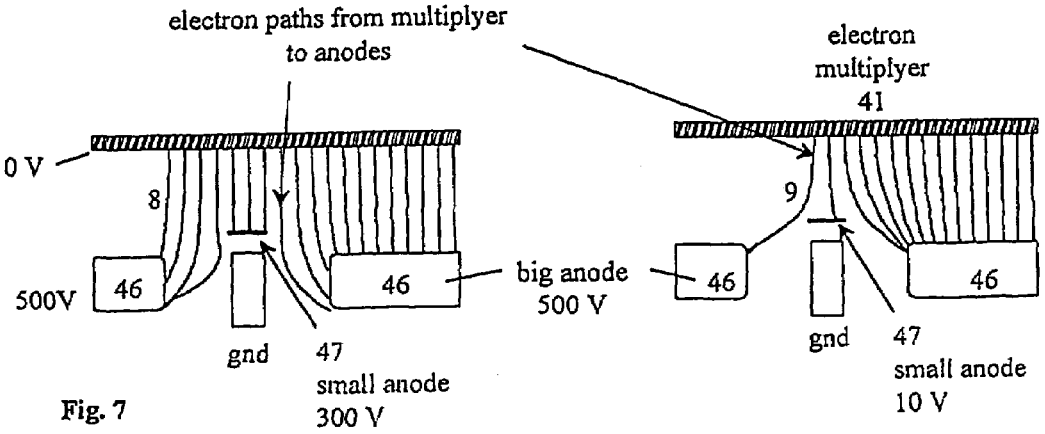
FIG. 7 is a schematic diagram showing numerical simulations of two electron paths of the detector of FIG. 6 achieved by varying the electrical field within the detector.

FIG. 6 shows an alternate embodiment of the present invention. In this embodiment, the electrical potential applied to the small anode 47 is variable, which gives a method for adjusting the small anode's 47 anode fraction. The lower potential on the small anode 47 is less attractive to the electrons 8 and 9 resulting in detection of a smaller fraction of particles 8 and 9 by the small anode 47. Alternative methods for changing the fractions detected by an anode include the application of magnetic fields and physically constructing the instrument in a way such that the ion beam hits the various anodes with different intensities. In most cases, a mixture of these three methods will be used. For example, the detector shown in FIG. 7 varies each anode's anode fraction through a combination of size differences, geometry, and electrical potential.

Figure 8:
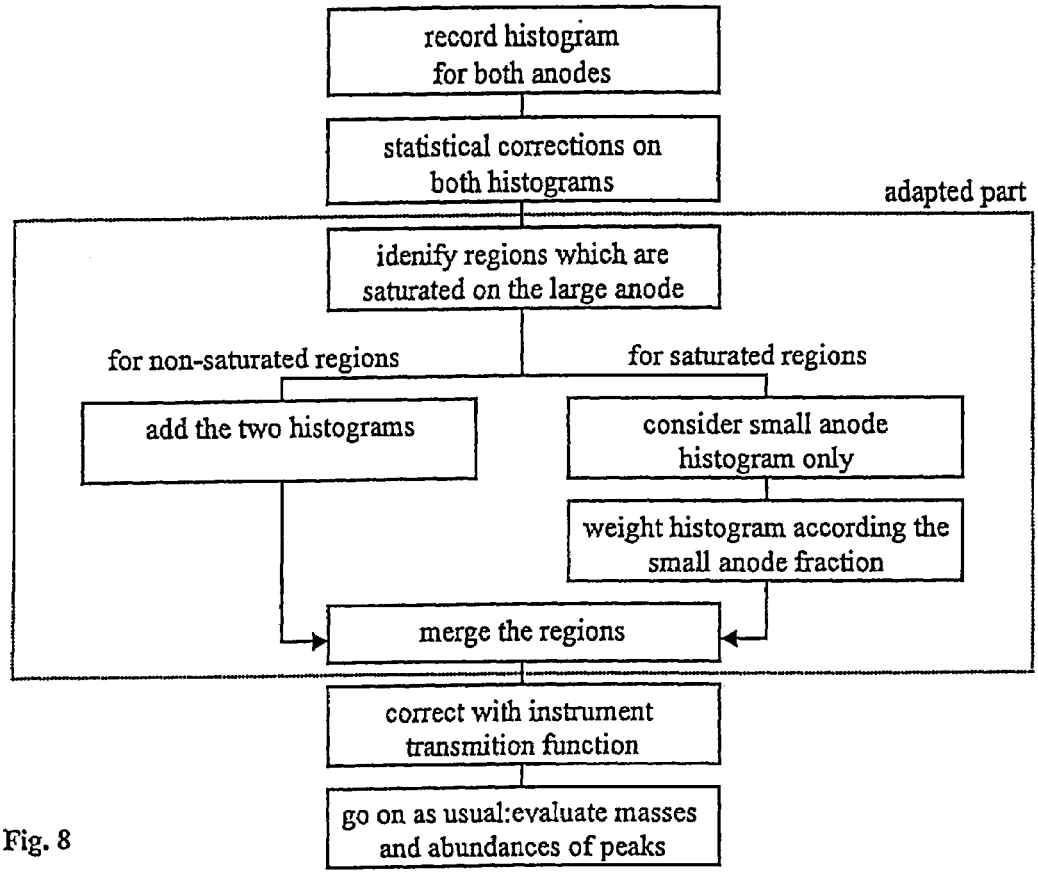
FIG. 8 is a flowchart showing a method for evaluating the spectra taken with a 2-anode detector with unequal-sized anodes.
Figure 9:
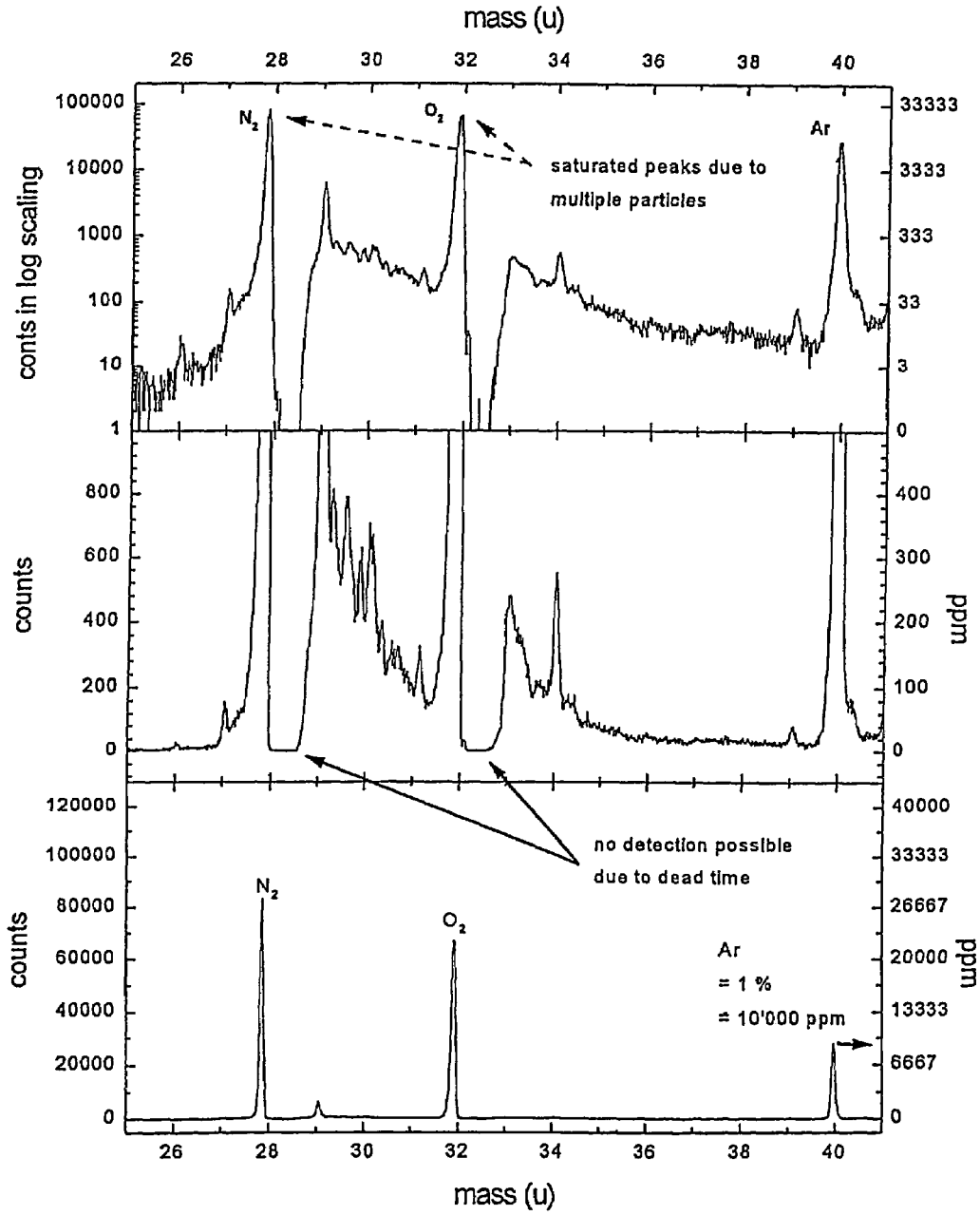
FIG. 9 is a graph showing a sample spectrum of air with two saturated peaks ($N_2$ and $O_2$).

FIG. 8 is a flowchart showing a preferred method for evaluating the spectra taken with a 2-anode detector with unequal anode sizes. The additional procedures are encapsulated in the dashed box. As can be seen from the flowchart, upon creating anode histograms, the histograms are analyzed to detect which spectrum regions reflect large anode saturation. In many cases, certain spectrum regions will theoretically be assumed to be saturated and will be treated as such by the method. However, saturation can also be detected by comparing the large anode histogram to the small anode histogram. The small anode histogram, which is not saturated, will accurately reflect the ratio between counts for various regions. Upon comparing these ratios to the same ratios on the large anode histogram, it becomes apparent which histogram regions are saturated. Saturated regions are evaluated by adding the region's large anode histogram to a weighted small anode histogram for that region. The weighting factor is inversely proportional to the small anode's detection fraction. Unsaturated regions are evaluated by adding the large anode histogram to the unweighted small anode histogram. Finally, the processed regions are merged to form a raw spectrum which is corrected with the instrument's transmission function.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. A time-of-flight mass spectrometer comprising:

an ion source that produces a primary beam of ionized particles;

transmission optics that focus said primary beam;

an extraction chamber that produces a secondary beam of ionized particles from said primary beam;

a flight tube that receives said secondary beam;

an acceleration chamber that directs said secondary beam into said flight tube;

an electron multiplier that receives said secondary beam and produces electron emissions in response to said ionized particles in said secondary beam;

an analog detector with an anode positioned to receive a first portion of said electron emissions; and a digital detector with a plurality of anodes positioned to receive a second portion of said electron emissions wherein at least two of said plurality of anodes each has a different anode fraction.

2. The time-of-flight mass spectrometer of claim 1 wherein at least two of said plurality of anodes of said digital detector have different electrical potentials.

3. The time-of-flight mass spectrometer of claim 1 wherein at least two of said plurality of anodes of said digital detector receive said different anode fraction due to said flight tube's physical geometry.

4. The time-of-flight mass spectrometer of claim 1 wherein at least two of said plurality of anodes of said digital detector are the same physical size.

5. The time-of-flight mass spectrometer of claim 1 wherein at least two of said plurality of anodes of said digital detector are different physical sizes.

6. The time-of-flight mass spectrometer of claims 1 wherein at least two of said plurality of anodes of said digital detector receive said different anode fraction due to application of a magnetic field.

* * * * *